US005558028A

United States Patent [19]

Lin

[11] Patent Number: 5,558,028

[45] Date of Patent: Sep. 24, 1996

[54] INCINERATOR FRAME

[76] Inventor: Wen-Chiang H. Lin, No. 1, Liu Tsuoh, Liu Tsuoh Li, Chia-Yih City, Taiwan

[21] Appl. No.: 500,772

[22] Filed: Jul. 11, 1995

[51] Int. Cl.[6] ..... F23G 5/00

[52] U.S. Cl. ..... 110/243; 110/244; 110/215

[58] Field of Search ..... 110/243, 244, 110/215

[56] References Cited

U.S. PATENT DOCUMENTS

| | | | |
|---|---|---|---|
| 3,817,192 | 6/1974 | Watterback | 110/244 |
| 4,699,588 | 10/1987 | Zinn et al. | 110/244 |
| 4,722,286 | 2/1988 | Portner | 110/243 |
| 5,159,884 | 11/1992 | Malick | 110/243 |
| 5,445,087 | 8/1995 | Kaneko | 110/244 |

FOREIGN PATENT DOCUMENTS

| | | | |
|---|---|---|---|
| 95/04898 | 2/1995 | WIPO | 110/244 |

*Primary Examiner*—Weilun Lo
*Attorney, Agent, or Firm*—Morton J. Rosenberg; David I. Klein

[57] ABSTRACT

An incinerator which includes a furnace shell, a filtering device and an ash ejector is provided. Three blowers are placed around the furnace shell along tangent lines to the outer furnace shell wall. The air blown by the blowers forms a whirling airflow within the incinerator. Upper and lower guide plates are affixed within the furnace shell to divide the incinerator into a space for supplying garbage and a second burning region. The hot airflow containing ashes is carried to a filtering device and sprayed with water. The ashes are then trapped on filter material. Ash that remains on the bottom of the furnace shell can be poured into an ash collector by a rotatable grate. The ashes from the ash collector are removed by an auger stem of an ash ejector located below the ash collector.

3 Claims, 9 Drawing Sheets

INCINERATOR FRAME

BACKGROUND OF THE INVENTION

1. Field of the Invention

The present invention relates to an incinerator frame, and more particularly to a repeat cycle incineration process for burning garbage and producing steam-power for generating electricity.

2. Prior Art

Processing garbage has become a great problem to modern society. Along with improving peoples' quality of life and increasing peoples' consciousness with respect to environmental protection the issue of pollution has become more and more important. So far, the primary method of garbage disposal is incineration, and along with differences in the quantity of garbage that can be processed, incinerators vary in style, size and quality.

Although conventional incinerators have many advantages individually, they also have a common problem of incomplete burning. During burning, much ash, dust and high temperatures are produced. In general, the method of removing such byproducts is by sweeping out and throwing away the dust, while the ash is ejected from the chimney into the sky, and the high temperatures are used to heat water. In this case, the dust thrown away and the ash ejected from the chimney will pollute the environment, especially when the ash contains unburned substances.

The object of the present invention is to provide a repeat cycle incinerator.

It is a further object of the present invention to apply the high temperatures produced by the burning process to produce steam for generating electricity. Additionally, the present invention provides an improved grate and ash ejector.

SUMMARY OF THE INVENTION

The present invention provides an incinerator, which includes a furnace shelf, a filtering device and an ash ejector.

The incinerator has a tubular shape, the upper end of which includes a charging funnel extending to the outside. The charging funnel has an air valve and block board opening to the inside. Surrounding the furnace shell there are three sets of blowers, each placed on a tangent line of the outside wall of the furnace shell. Each blower has a blowpipe whose interface with the furnace shell outside wall is sealed. The wall of the furnace chamber is formed with a plurality of air inlets directed in accordance with the same tangent line of a corresponding blower. Near the top of the furnace chamber there is provided a fixed upper guide plate, and a lower guide plate, between which is formed a second burning space, the upper and lower guide plates each have openings arranged in staggered relationship. At the top end of the furnace shell a big exhaust pipe extends therefrom and connects to an exhaust blower and a filtering device. At the bottom of the furnace chamber is a grate having a plurality of rotatable shelves driven by at least one motor disposed external the furnace chamber. Under the grate there is a diversion space, the bottom of the diversion space having a funnel shaped ash collector connected to an ash ejector.

The filtering device, disposed external to the furnace shell, at the end of the exhaust pipe, is a water type filtering system. The filter has an inlet at the top, and the upper portion of the filter has several rows of spray pipes arranged therein. Several layers of filter material are vertically disposed in the filter, and a water outlet is located at the side of the bottom of the filtering device.

The ash ejector is connected below the ash collector. From the bottom of the ash collector a rolling auger stem, driven by a motor, is provided for removing the ashes that have fallen down from the ash collector.

DESCRIPTION OF THE PREFERRED EMBODIMENT

Referring to FIGS. 1–9, the present invention includes a furnace shall 10, a filtering device 20 and an ash ejector 30.

Figure 1:
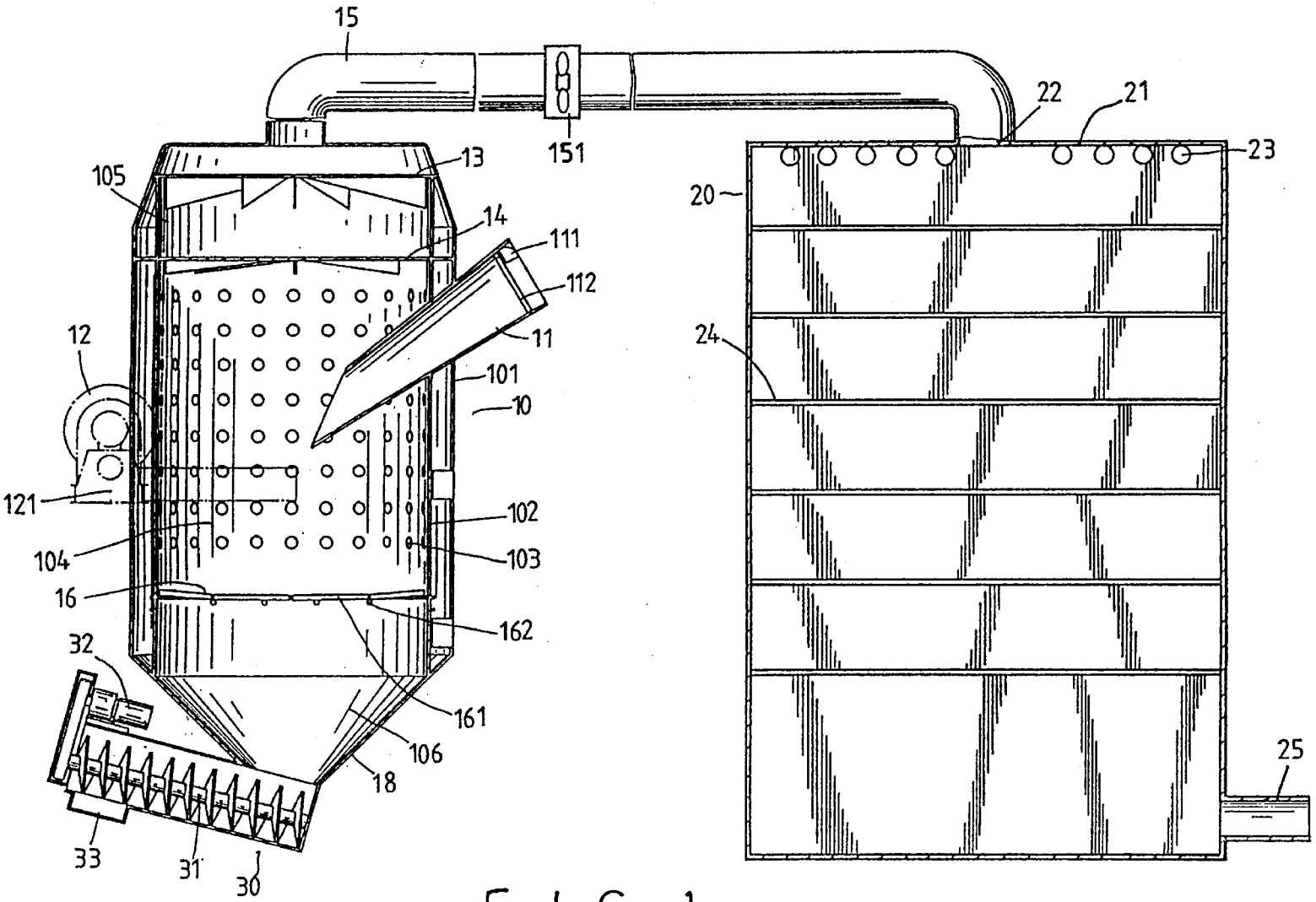
FIG. 1 is a cross-section view of the present invention.
Figure 2:
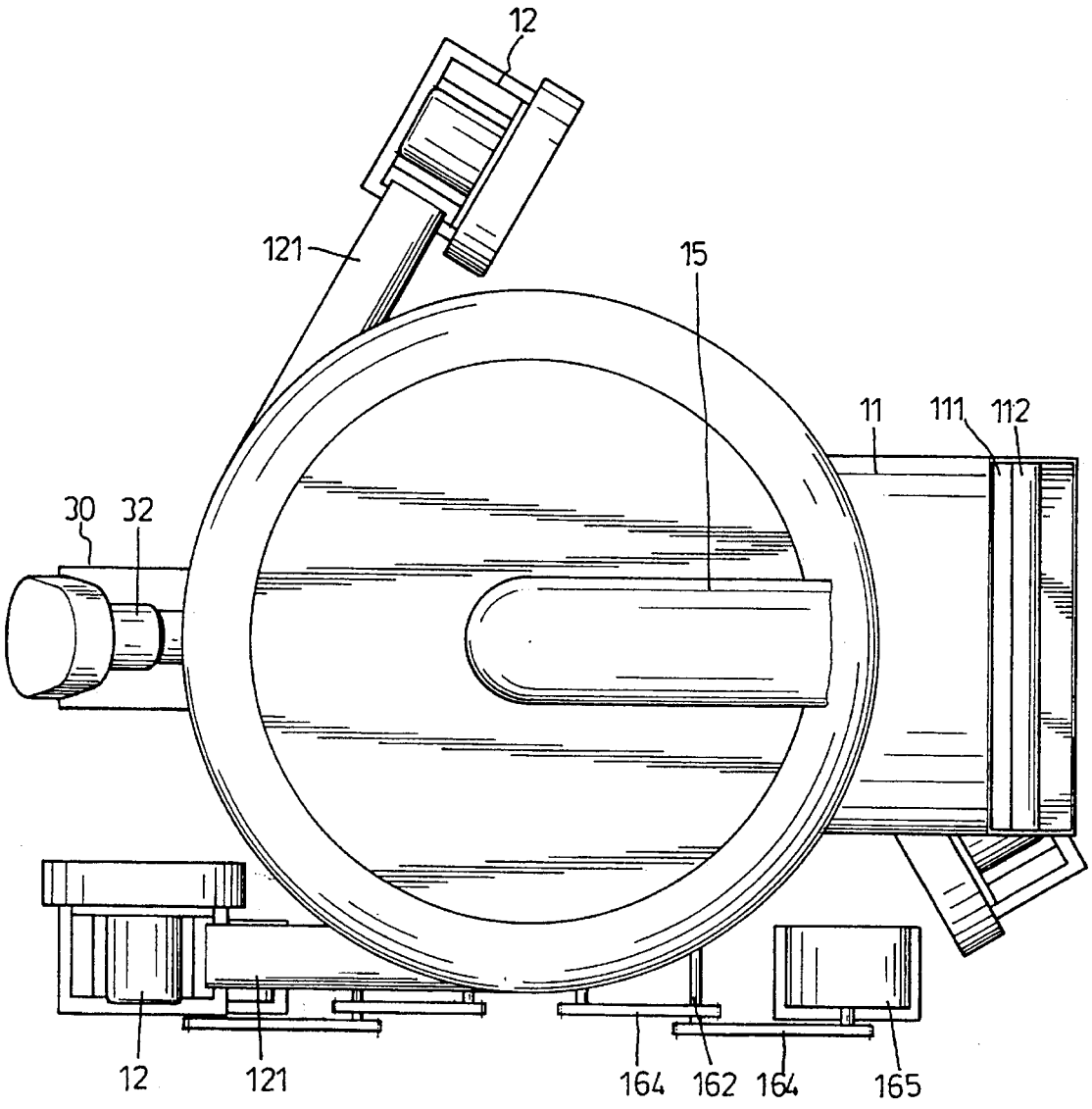
FIG. 2 is a top view of the present invention.

Furnace shell 10 is shown to have an inside and outside tubular shape. Extending out from an upper portion of furnace shell 10 there is a charging funnel 11. Adjacent the distal end of the funnel 11 an air valve 111 and a block board 112, opening to the inside, is provided. Surrounding the outer furnace shell wall 101, three sets of blowers 12 are each placed on a tangent line with respect to the outer furnace shell wall 101, as shown in FIG. 2. A space is provided between the wall of the furnace chamber 102 and the interior surface of the outer furnace shell wall 101, and the wall of the furnace chamber 102 has a plurality of air inlets 103 formed therethrough and directed along the same tangent line as the blowers 12.

Figure 3:
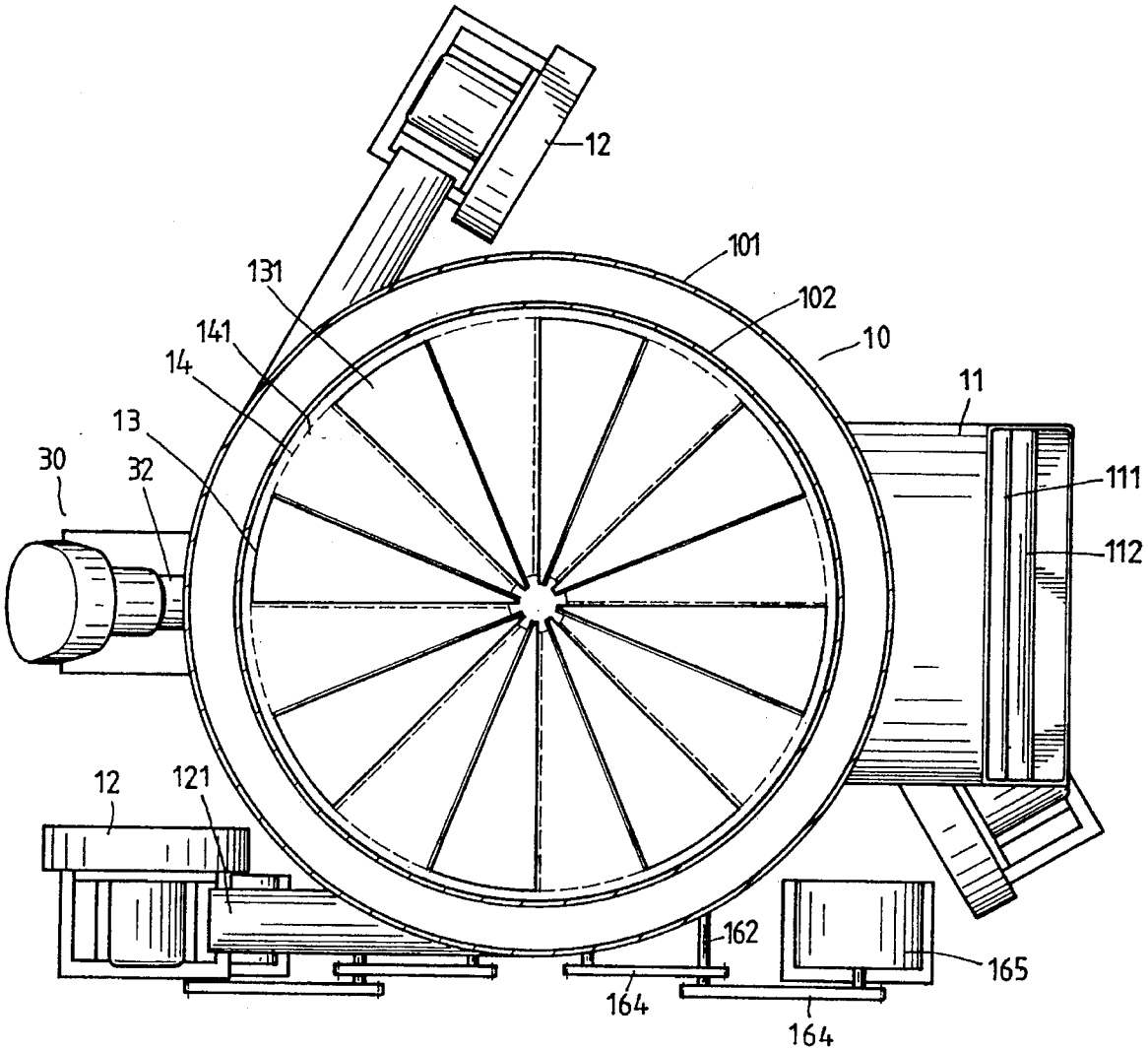
FIG. 3 is a top view showing the upper and lower guide plates of the present invention.

The furnace chamber 102 has upper, lower guide plates 13, 14 affixed near the top portion of the interior of furnace chamber 102. The lower guide plate 14 is positioned at a location higher than the vertical position of the blowers 12. Both guide plates 13 and 14 divide the furnace body into two burning spaces, in which the space under the lower guide plate 14 defines the first burning space 104, and the space between both guide plates 13 and 14 defines the second burning space 105. Both guide plates 13 and 14 each have openings 131, 141 arranged in staggered relationship, as shown in FIG. 3. The top end of the furnace shell 10 is connected to an exhaust pipe 15 of large size, in which is located an exhaust blower 151, the distal end of the exhaust pipe being connected to the filtering device 20.

Figure 4:
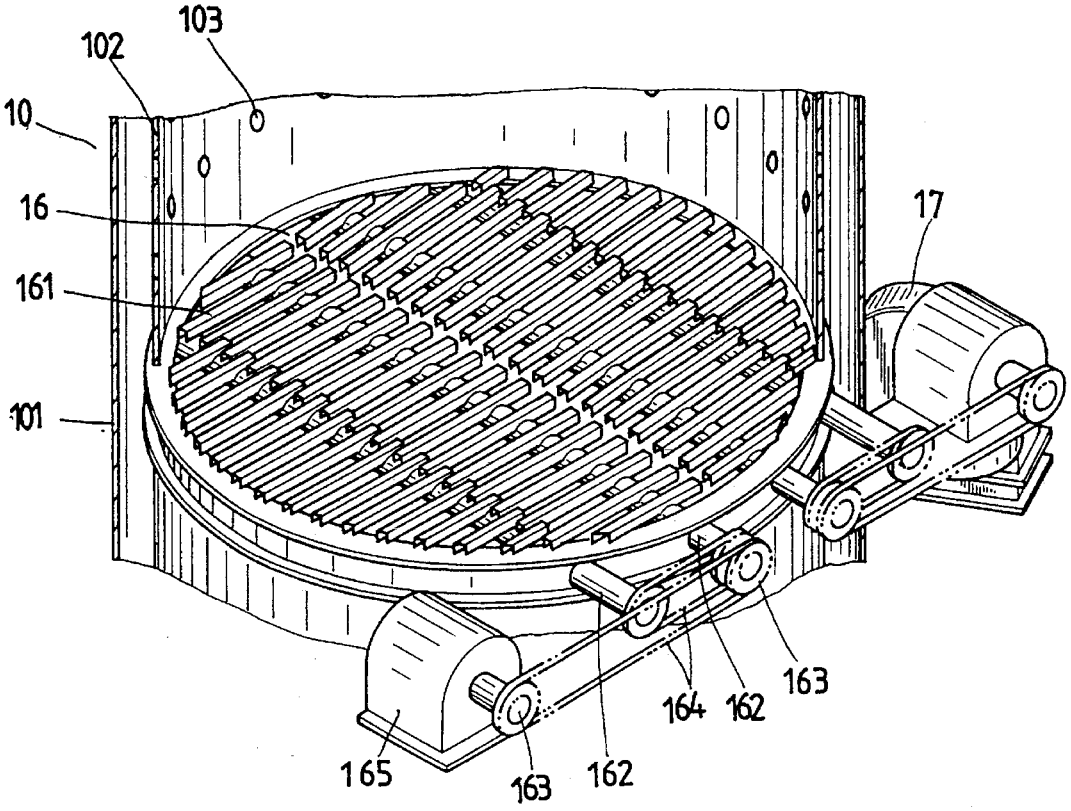
FIG. 4 is a perspective view showing the grate of the present invention.

A grate 16 is located at the bottom of the furnace shell 10. The grate 16 comprises a plurality of shelves 161, the shelves 161 being mounted on respective shafts 162, in parallel relationship. One end of each of the shafts 162 extends out from the furnace shell 10 and has a sprocket wheel 163 affixed thereto, to be driven by a chain 164 coupled to a sprocket wheel 163 of a respective one of several motors 165, to rotate each shaft 162 and thereby turn each shelf 161, as shown in FIG. 4. A diversion space 106 is located under the grate 16. A diversion blower 17 is coupled to one side of the diversion space 106, along a tangent line with respect to the furnace wall. A funnel shaped ash collector 18 is disposed below the diversion space 106. An ash ejector 30 is located under the furnace shell 10 and below the ash collector 18.

Filtering device 20 is constructed separately from the furnace shell 10, and is connected to the outlet end of the exhaust pipe 15. The filtering device 20 includes a water container 21 having an inlet 22, on the top end thereof, connected to the exhaust pipe 15. Several spray pipes 23 are arranged on the inside top end of the container 21. Between the top and bottom of container 21 there are laid out several layers of filter material 24. A water outlet 25 is located at the bottom side of the container 21.

Ash ejector 30 under the ash collector 18 of the furnace shell 10, has an auger stem 31 rotatively driven by a motor 32 to eject ashes from the ash outlet 33.

Figure 5:
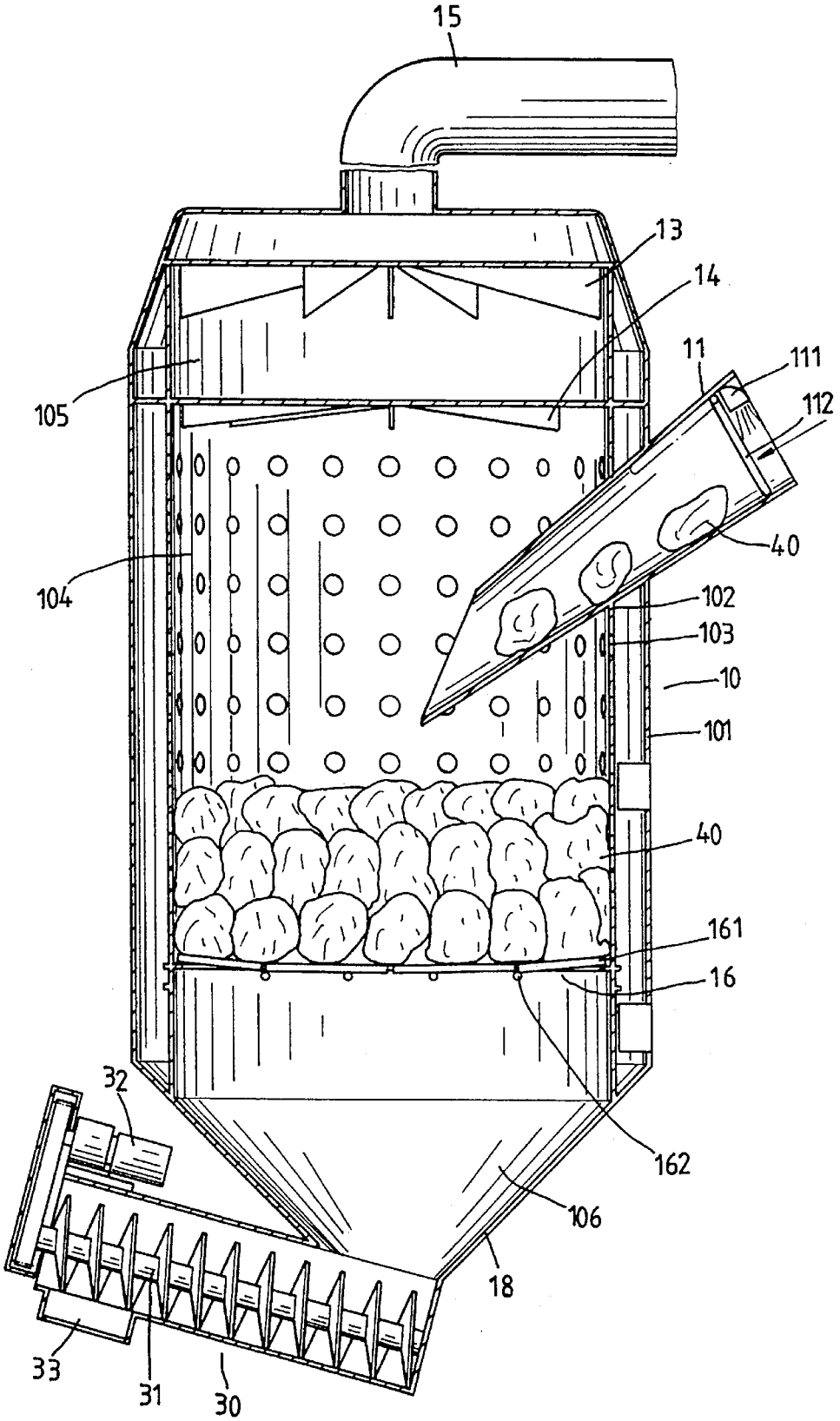
FIG. 5 is a view showing a garbage charging operation of the present invention.
Figure 6:
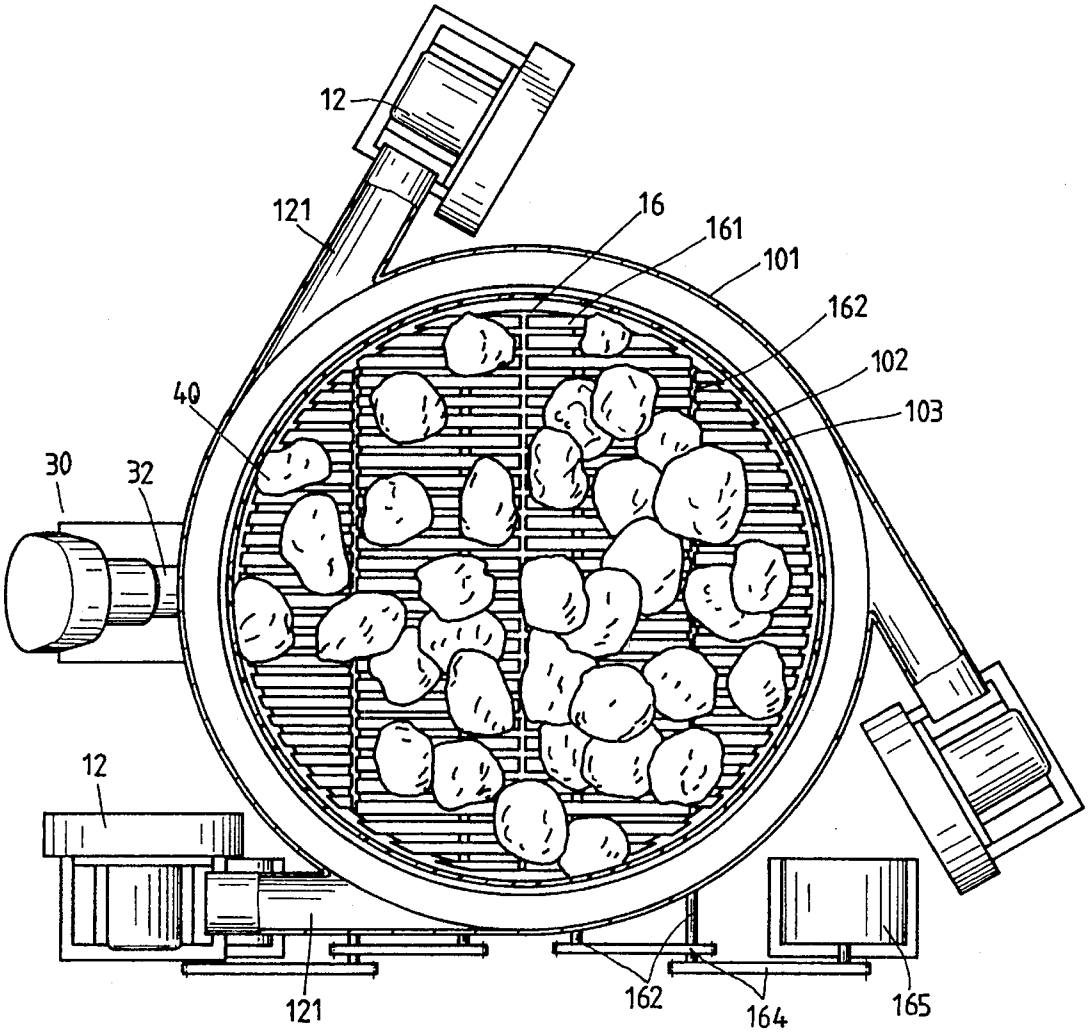
FIG. 6 is a view showing the start of the burning operation of the present invention.

As shown in FIGS. 5 and 6, during use, the garbage 40 is delivered into the furnace chamber 102 through the charging funnel 11. Depending on the weight of individual portions of the garbage 40, the garbage 40 pushes the block board 112 open and slides down the charging funnel 11. Meanwhile, a large air current is blown to the air valve 111, to cut off the airflow from the furnace shell 10 to the outside, for preventing high temperature airflow therefrom. The garbage 40 falls down into the first burning space 104 of the furnace chamber 102, and the blowers 12 blow air around the wall of the furnace chamber 102. The air then flows through the air inlets 103 formed in the wall of the furnace chamber 102. The large air current blown into the inside of the furnace chamber 102 forms a whirling air current along the wall of the furnace chamber 102. This whirling air current surrounds the fire and the garbage 40 at the center of the furnace chamber 102. In the diversion space 106, the diversion blower 17 also blows air for supporting combustion, that combustion supporting airflow rushes up through the spaces in the grate 16 to supply sufficient oxygen to the first burning space 104.

In addition to the ashes 41 of burned garbage 40, there are many particles 42 formed during burning in the furnace chamber 102. The particles 42 rise up along with the hot airflow, produced by the burning process, and flow through the opening 141 of the lower guide plate 14 into the second burning space 105 located between the upper and lower guide plates 13 and 14. Due to the staggered arrangement of the respective openings 131, 141 of the upper and lower guide plates 13, 14, the unburned particles 42 cannot rush out through the opening 131 of the upper guide plate 13. The particles 42 will circle round between the upper and lower guide plates 13 and 14, and depending on the high temperature therein, carry on a second burning. The high temperature produced in the second burning can dry the garbage 40 in the first burning space 104.

Figure 7:
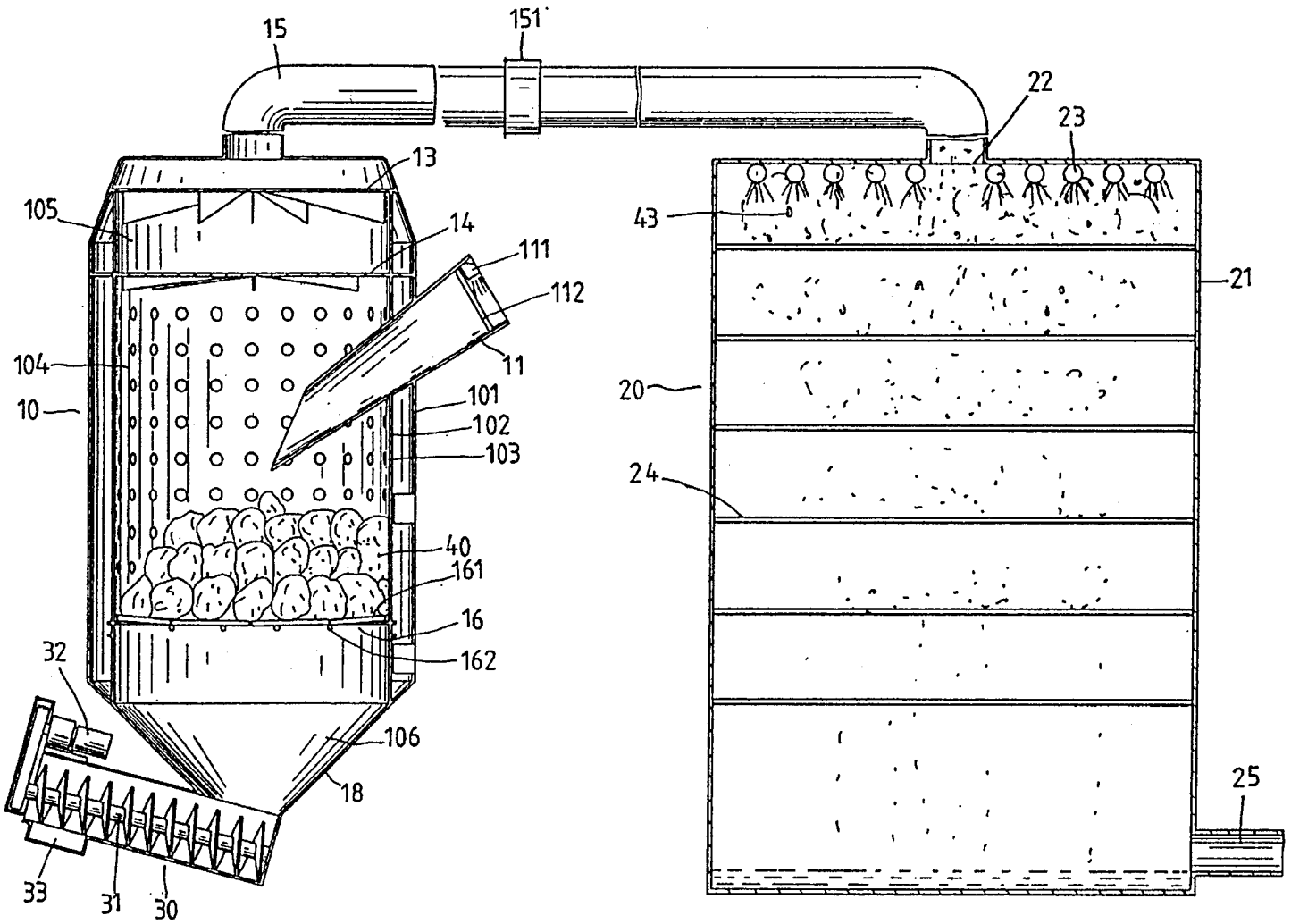
FIG. 7 is a view showing the steam exhausting operation of the present invention.

After exposure to a second burning, the particles 42 are burned completely and become ashes 43. The ashes 43 flow out the opening 131 of the upper guide plate 13 along with the whirling hot airflow to the exhaust pipe 15, at the top of the furnace shell 10. The exhaust blower 151 blows the hot airflow containing the ashes 43 into the air inlet 22 of the filtering device 20. The hot airflow containing the ashes will mix with water sprayed from the spray pipes 23. The water carrying the ashes flows through the several layers of the filtering material 24, the ashes being blocked by the layers of the filtering material 24. Clear water flows out from the water outlet 25 on the bottom side of the water container 21 of filtering device 20, as shown in FIG. 7.

Figure 8:
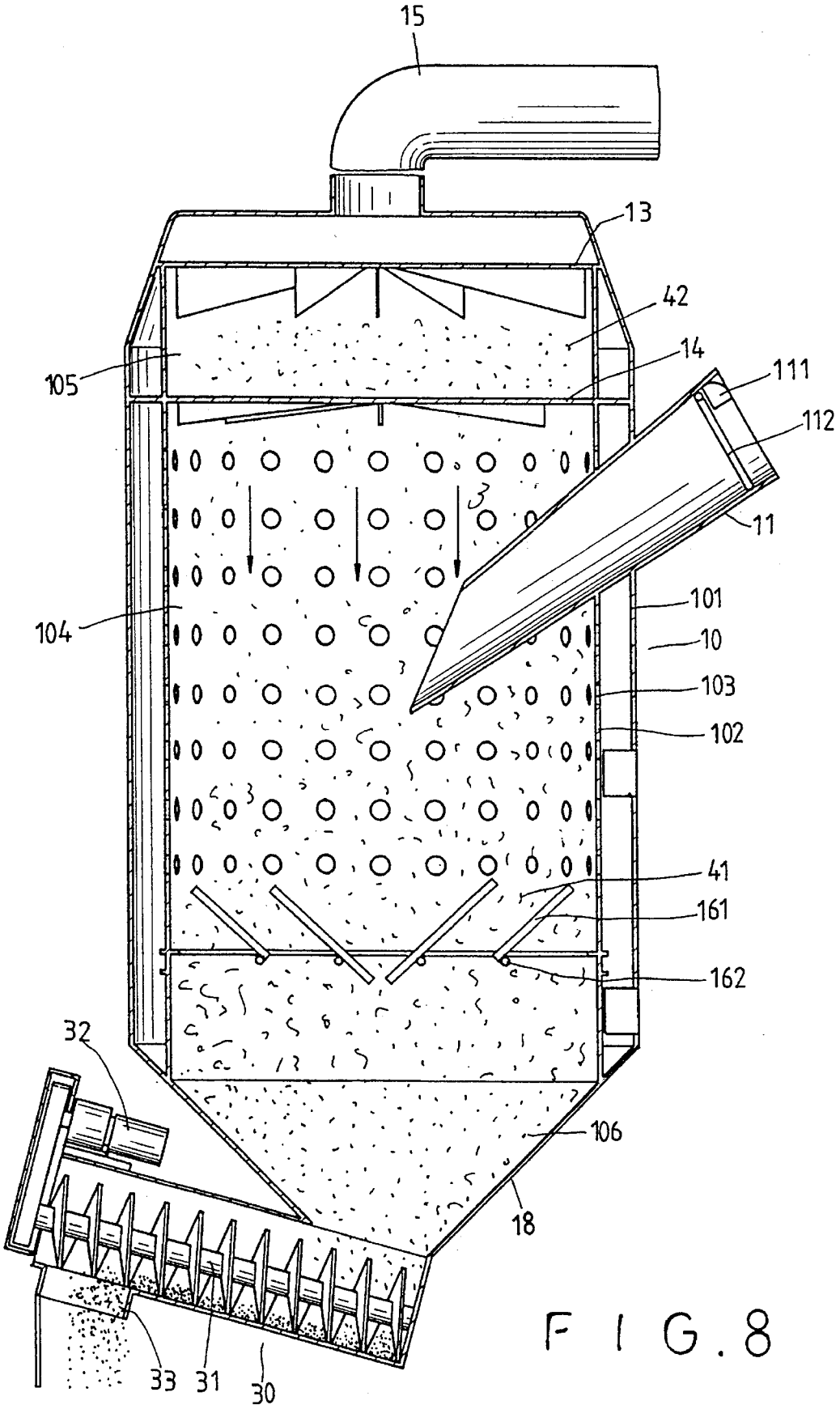
FIG. 8 is a view showing the grate turning operation and ejection of ashes of the present invention.
Figure 9:
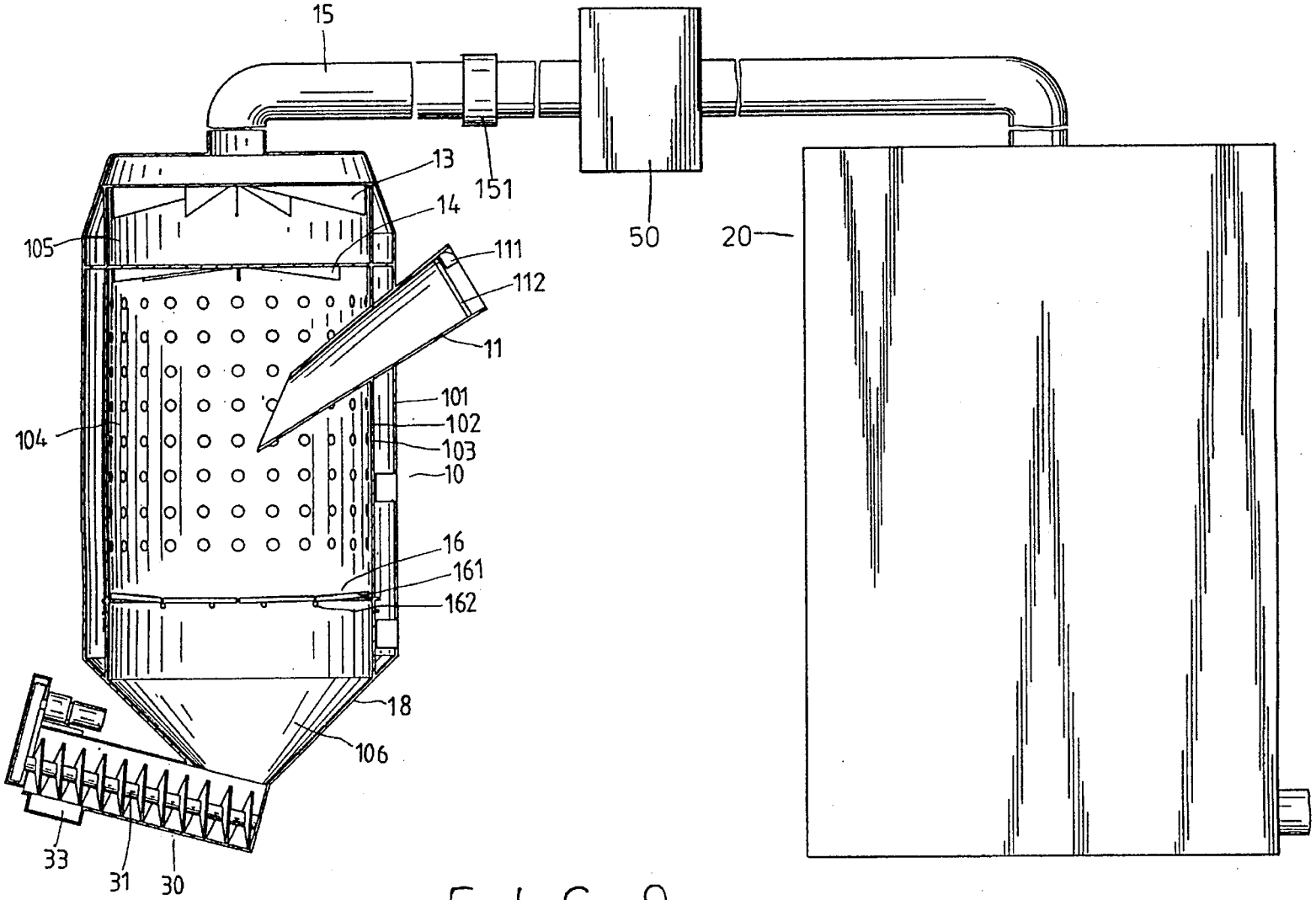
FIG. 9 is a view showing an operation of the present invention.

On the other hand, in the furnace shell 10, the burned ashes 41 are piled up on the grate 16. Subsequent to the garbage 40 inside of the furnace shell 10 completely becoming ashes, the motors 165 are then run to drive respective chains 164, sprocket wheels 163 and shafts 162, to cause the shelves 161 to tilt and thereby empty the ash piled up on the grate 16 into the ash collector 18. Due to the funnel shape of the ash collector 18, all the ashes 41 slide down into the ash ejector 30, as shown in FIG. 8. The motor 32 of the ash ejector 30 drives the rotation of auger stem 31, so the auger stem 31 displaces the ashes 41 to the ash outlet 33, from which they are expelled.

Thus, the above described incinerator frame has the following features.

1. The charging funnel 11 includes an air valve 111 and a block board 112, such that when the garbage 40 is pushed into the furnace shell 10, the hot airflow therein cannot flow out. That arrangement can save energy, and avoids hot airflow from flowing out and burning a worker's body.

2. The charging funnel 11 includes a block board 112, and the blowpipe 121 of each of the blowers 12 is sealed to the outer furnace shell wall 101, so that the high expansion pressure just flows out from the exhaust pipe at the top of the furnace shell 10.

3. The blowers 12 are placed so as to surround the outer furnace shell wall 101, the air is blown into the space between the outer furnace shell wall 101 and the furnace chamber 102, and into the furnace chamber 102 through the air inlets 103 along a line that is tangent to the outer furnace shell wall 101. The airflow thus formed is a whirling airflow that separates the wall of the chamber from the fire located at the center of the chamber. As the air blown by the blowers 12 can cool the wall of the chamber, the material of the chamber can be a high heat-resistant material, but it does not need to be an expensive special superior heat-resistant material, and the life of the chamber is extended.

4. Because the air blown in through the air inlets 103 on the wall of the furnace chamber is very even, such aids the efficiency of the burning of garbage 40. There is sufficient air to fully fill the interstices between the portions of garbage 40, thereby contributing to the burning process.

5. As above mentioned, the upper and lower guide plates 13 and 14 have openings that are arranged in a staggered state. The space between the plates defines a second burning space 105, the unburned particles from the first burning space 104 being burned completely there. The high temperature produced in the second burning space being used for drying the garbage 40 in the first burning space 104.

6. The filtering device 20 filters the ashes carried from the furnace shell 10 through the exhaust pipe 15. The ashes are trapped on layers of filter material in the water container, and cannot pollute the environment.

7. The rotatable grate 16 is advantageous for thoroughly removing ashes to keep air flowing smoothly.

8. Due to the use of an auger stem 31 disposed in the ash ejector 30, the ash that has fallen into the ash collector 18 can be ejected completely without manual effort.

Another feature of the present invention is the use of a boiler device 50 coupled between the exhaust pipe 15 and the filtering device 20. The high temperature produced in the burning process of the furnace is used to heat water to create steam for generating electricity.

I claim:

1. An incinerator frame, comprising:

a furnace shell formed by a longitudinally extended tubular furnace chamber wall extending between upper and lower ends of said furnace shell to define a furnace chamber and a longitudinally extended outer wall disposed in spaced concentric relationship with respect to said furnace chamber wall to define an air passage therebetween, said furnace chamber wall having a plurality of spaced air inlet openings formed therethrough to provide open fluid communication between said air passage and said furnace chamber, said furnace shell including a charging funnel extending outwardly therefrom and in open communication with said furnace chamber, said charging funnel having an air valve and a block board disposed at a distal end thereof, said furnace shell having a diversion space disposed adjacent a lower end of said furnace chamber, said upper end of said furnace shell having an exhaust outlet formed through said upper end thereof for passage of exhaust gases therethrough;

a set of three blowers disposed in radially spaced relationship around said furnace shell, each of said blowers having an air outlet pipe sealingly coupled to said outer wall of said furnace shell and disposed in tangential relationship therewith for providing a flow of air through said air passage and plurality of air inlet openings to form a whirling air circulation about a perimeter portion of said furnace chamber;

an upper and a lower guide plate disposed within said furnace chamber in longitudinally spaced relationship adjacent an upper end thereof for dividing said furnace chamber into first and second burning spaces, said upper and lower guide plate each having an opening formed therethrough to form said second burning space therebetween;

a rotatable grate disposed within said furnace shell between said furnace chamber and said diversion space;

a fourth blower having an outlet coupled in tangential relationship with said outer wall adjacent said furnace shell lower end in fluid communication with said diversion space for providing a flow of air into said diversion space and through openings in said grate into said furnace chamber;

a funnel-shaped ash collector coupled to said lower end of said furnace shell in open communication with said diversion space for receiving ashes displaced by rotation of said grate;

an exhaust pipe coupled in fluid communication with said exhaust outlet;

filter means coupled in fluid communication to said exhaust pipe for filtering said exhaust gases flowing from said exhaust pipe, said filter means including means for spraying water through said exhaust gases and a plurality of layers of filter material to trap particulates therein; and, ash ejection means coupled to a lower end of said funnel-shaped ash collector, said ash ejection means including (1) an auger extending between said ash collector and an ash outlet, and (2) a motor for rotatively driving said auger to displace ash from said ash collector to said ash outlet.

2. The incinerator frame as recited in claim 1 where said openings in said upper and lower guide plates are arranged in staggered relationship.

3. The incinerator frame as recited in claim 1 where said rotatable grate includes (1) a plurality of shelves respectively coupled to a plurality of rotatable shafts, (2) a plurality of sprocket wheels respectfully coupled to said plurality of rotatable shafts, and (3) a motor coupled to said plurality of sprocket wheels by a chain for angularly displacing said plurality of shelves.

* * * * *